US012006809B2

(12) United States Patent
Nguyen et al.

(10) Patent No.: US 12,006,809 B2
(45) Date of Patent: Jun. 11, 2024

(54) METHODS FOR ENHANCING AND MAINTAINING HEAT TRANSFER EFFICIENCY BETWEEN GEOTHERMAL HEAT AND INJECTION FLUID

(71) Applicant: Halliburton Energy Services, Inc., Houston, TX (US)

(72) Inventors: Philip D. Nguyen, Houston, TX (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 17/716,571

(22) Filed: Apr. 8, 2022

(65) Prior Publication Data

US 2023/0323762 A1 Oct. 12, 2023

(51) Int. Cl.
*E21B 43/267* (2006.01)
*E21B 43/17* (2006.01)
(Continued)

(52) U.S. Cl.
CPC ..... *E21B 43/267* (2013.01); *E21B 43/17* (2013.01); *E21B 47/07* (2020.05); *F24T 10/20* (2018.05)

(58) Field of Classification Search
CPC ..... E21B 43/267; E21B 43/17; E21B 47/07
See application file for complete search history.

(56) References Cited

U.S. PATENT DOCUMENTS 6,095,244 A * 8/2000 Graham ..... E21B 43/17 166/272.2
6,758,271 B1 * 7/2004 Smith ..... E21B 47/07 166/305.1
(Continued)

FOREIGN PATENT DOCUMENTS

CA 2929556 C 4/2019
WO 2016/053288 A1 4/2016

OTHER PUBLICATIONS

Roberts, Crystal et al., "Imperial Oil's Cyclic Solvent Process: A 'Game Changing' Alternative to the Thermal Recovery Process", U.S. Commercial Service, United States of America Department of Commerce, Jul. 2013, 3 pages.
(Continued)

*Primary Examiner* — Catherine Loikith
(74) *Attorney, Agent, or Firm* — Conley Rose, P.C.; Rodney B. Carroll

(57) ABSTRACT

Methods and compositions for enhancing the flow rate and heat transfer efficiency of wellbores and/or propped fractures for use in geothermal operations are provided. In some embodiments, the methods comprise: injecting an etching agent into an injection inlet of a first wellbore penetrating a first portion of a subterranean formation, wherein the injection inlet is disposed at a first location at or near a surface of the subterranean formation; injecting a working fluid having a first temperature into the injection inlet; allowing at least a portion of the working fluid to flow from the injection inlet to a production outlet of a second wellbore penetrating a second portion of the subterranean formation; and producing the portion of the working fluid out of the production outlet at a first rate and at a second temperature that is higher than the first temperature.

21 Claims, 3 Drawing Sheets

(51) Int. Cl.
*E21B 47/07* (2012.01)
*F24T 10/20* (2018.01)

(56) References Cited

U.S. PATENT DOCUMENTS 7,644,761 B1 * 1/2010 Gu ..... E21B 43/267 166/308.1
8,794,322 B2 8/2014 Reyes et al.
9,255,468 B2 2/2016 Reyes et al.
9,540,560 B2 1/2017 Beuterbaugh et al.
9,664,017 B2 5/2017 Reyes et al.
9,745,506 B2 8/2017 Reyes et al.
9,809,716 B2 11/2017 Beuterbaugh et al.
9,982,186 B2 5/2018 Beuterbaugh et al.
10,005,950 B2 6/2018 Smith et al.
10,138,560 B2 11/2018 Reyes et al.
10,190,030 B2 1/2019 Harrison et al.
10,190,034 B2 1/2019 LaBlanc et al.
10,221,347 B2 3/2019 Smith et al.
10,287,488 B2 5/2019 LaBlanc et al.
10,344,564 B2 7/2019 Beuterbaugh et al.
10,407,610 B2 9/2019 LaBlanc et al.
10,487,261 B2 11/2019 Beuterbaugh et al.
10,538,990 B2 1/2020 Bourcier et al.
10,633,581 B2 4/2020 LaBlanc et al.
10,640,697 B2 5/2020 Reyes et al.
10,711,181 B2 7/2020 Beuterbaugh et al.
10,723,939 B2 7/2020 Beuterbaugh et al.
10,738,237 B2 8/2020 Beuterbaugh et al.
10,793,769 B2 10/2020 Nguyen et al.
10,968,727 B2 4/2021 Dusterhoft et al.
10,988,674 B2 4/2021 Nguyen et al.
11,001,740 B2 5/2021 Ramirez Angulo et al.
11,053,786 B1 7/2021 Nguyen et al.
11,084,971 B2 8/2021 Belakshe et al.
11,084,976 B2 8/2021 Beuterbaugh et al.
11,091,984 B2 8/2021 Beuterbaugh et al.
11,236,599 B2 2/2022 Nguyen et al.
2013/0333892 A1 * 12/2013 McClung, IV ..... E21B 43/27 166/308.3
2015/0218436 A1 * 8/2015 Godavarthy ..... C09K 8/035 507/241
2017/0198195 A1 7/2017 Beuterbaugh et al.
2019/0249065 A1 8/2019 Singh et al.
2020/0102492 A1 4/2020 Reyes et al.
2020/0140745 A1 5/2020 Chopade et al.
2020/0190396 A1 6/2020 Reyes et al.
2020/0190937 A1 * 6/2020 Nevison ..... E21B 43/267
2021/0198560 A1 7/2021 Beuterbaugh et al.
2021/0355370 A1 11/2021 Recio, III et al.
2022/0017812 A1 1/2022 Reyes et al.
2022/0049154 A1 2/2022 Recio, III et al.
2023/0235208 A1 * 7/2023 Evans ..... C09K 8/805 507/266

OTHER PUBLICATIONS

Evans, Brian Alan et al., U.S. Appl. No. 17/584,615, filed Jan. 26, 2022, "Methods and Compositions for Enhancing Integrity and Thermal Conductivity of Wellbores in Geothermal Operations", 20 pages.

* cited by examiner

METHODS FOR ENHANCING AND MAINTAINING HEAT TRANSFER EFFICIENCY BETWEEN GEOTHERMAL HEAT AND INJECTION FLUID

BACKGROUND

The present disclosure relates to systems and methods for enhancing the flow rate and heat transfer efficiency of subterranean systems for use in geothermal operations.

The high temperatures of subterranean formations allow for the production of geothermal energy. Geothermal energy production in subterranean systems operates by injecting fluid into a subterranean system, allowing it to become heated by the formation, and extracting the fluid. The high-temperature fluid may then be used for electricity generation, evaporation, heat exchange, or to circulate heat to one or more nearby buildings.

The flow rate of fluid transmitting between an injection inlet and a production outlet depends on the permeability of the wellbores and the propped fractures between injection and production. Permeability often decreases in subterranean systems due to the precipitation of silica and other solids during brine processing; over time, this precipitation may result in fouling and/or the formation of excessive scale within one or more wellbores. Scale tends to form in the pore spaces of formation matrices, thereby decreasing flow rates and permeability. As permeability decreases, a higher injection pressure is required to maintain the designed injection flow rate. Thus, higher usage of electricity is required to power injection equipment. Moreover, as scale formation increases, the efficiency of heat exchange within the wellbore may diminish.

BRIEF DESCRIPTION OF THE DRAWINGS

These drawings illustrate certain aspects of some of the embodiments of the present disclosure, and should not be used to limit or define the claims.

Figure 1:
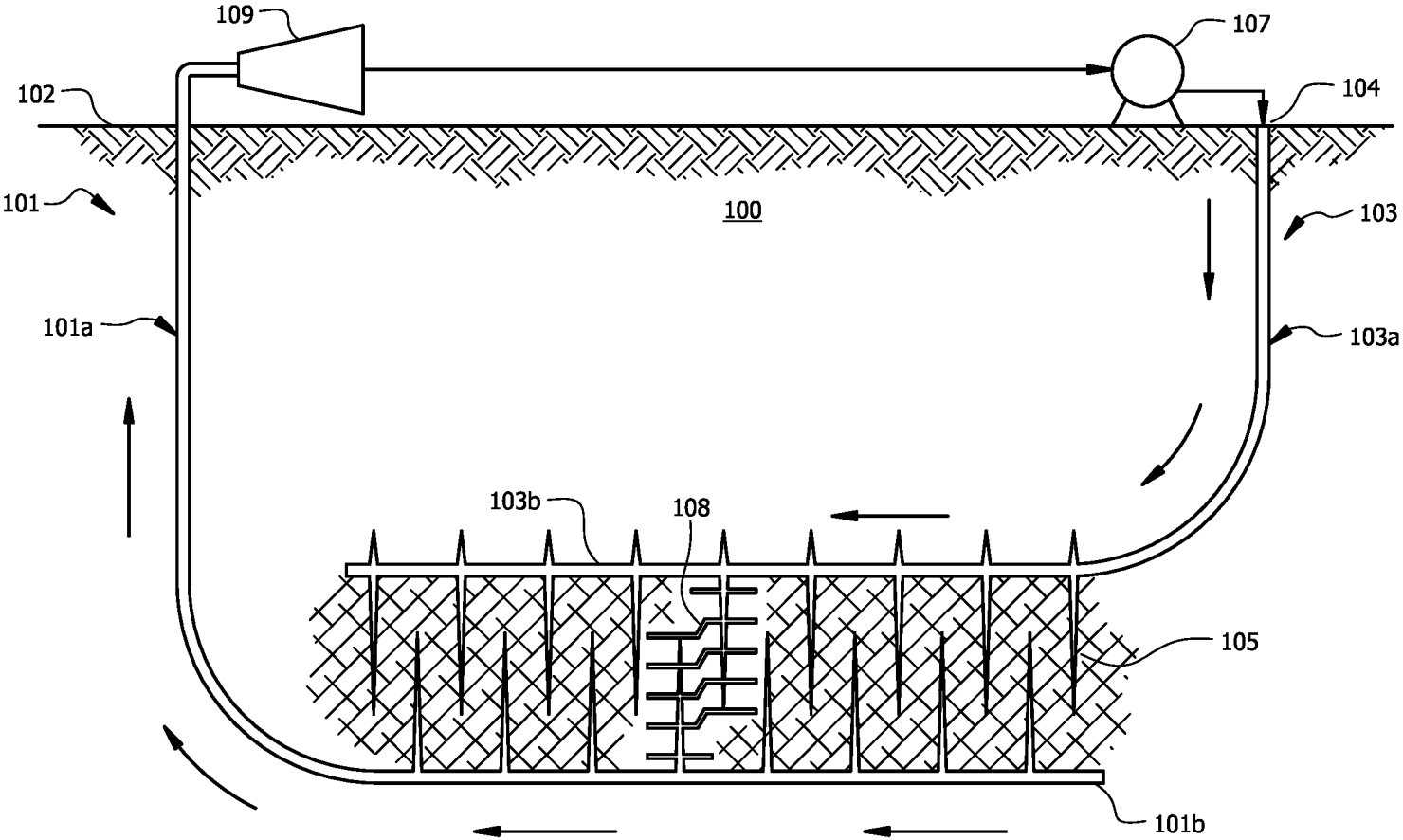
FIG. 1 is a schematic diagram illustrating a subterranean system having wellbores and propped fractures in a subterranean formation, in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only and are not exhaustive of the scope of the disclosure.

DESCRIPTION OF CERTAIN EMBODIMENTS

The present disclosure relates to systems and methods for enhancing the flow rate and heat transfer efficiency of subterranean systems for use in geothermal operations. More particularly, the present disclosure relates to methods and compositions for modifying wellbores and/or propped fractures with one or more of etching agents, scale inhibitors, and intermittent injection and/or production to more efficiently extract geothermal energy therefrom.

The methods and compositions disclosed herein may be used to drill new wells, to create fractures in fluid communication with one or more wellbores, or to otherwise modify existing wellbores, fractures, or subterranean formations. In certain embodiments, a working fluid may be injected into a wellbore, heated by the subterranean formation, produced through a production outlet, and used for geothermal energy production. The use of this process depends at least in part upon the flow rate of the working fluid in the subterranean system. In one or more embodiments, liquid scale inhibitors and/or solid slow-release scale inhibitors may be used to prevent the formation of scale. In calcite-laden formations, etching agents may be used to create conductive channels within the formation and to enlarge existing fractures. In certain embodiments, a chelant may perform a dual role as an etching agent and a scale inhibitor. In certain embodiments, a chelant may perform a single function as an etching agent or as a scale inhibitor. In one or more embodiments, production may be halted or slowed for a certain period of time while maintaining injection, thereby trapping the working fluid (and any etching agents and/or scale inhibitors contained therein) in the subterranean system for certain periods of time, after which the production may be resumed or increased.

Among the many potential advantages to the methods and compositions of the present disclosure, only some of which are alluded to herein, the methods and compositions of the present disclosure may increase fluid flow rate through the prevention of scale formation. Enlargement of existing fractures and creation of conductive channels via one or more etching agents may further increase a subterranean system's fluid flow rate. Moreover, by halting or slowing production for a certain period of time while maintaining injection, etching agents, scale inhibitors, and/or any other additives in the subterranean system may be given additional time to affect the subterranean system, pressure may be increased within the subterranean system (thereby causing dilation of existing fractures and potentially exposing more surface are to the injection fluid), and working fluid may be given additional time to heat. Geothermal subterranean systems are especially well-suited to the use of etching agents and scale inhibitors because these treatments may be periodically reapplied through inclusion of etching agents and scale inhibitors in the working fluid. Moreover, as etching, scale inhibition, and pressure from intermittent production take effect, the surface area accessible to the working fluid may increase, thereby improving and preserving thermal conductivity within the subterranean system.

The below systems and methods apply to subterranean systems. As used herein, a subterranean system is a high-temperature, underground system useable for geothermal energy production, including and without limitation oil wells, gas wells, propped fractures, high-temperature aquafers, high-temperature formations (including and without limitation high temperature dry formations), and combinations thereof.

In certain embodiments of the present disclosure, a base fluid may be provided as a component of, for example, a drilling fluid, fracturing fluid, and/or a working fluid. The base fluid used in the methods and systems of the present disclosure may comprise any base fluid known in the art, including aqueous base fluids, non-aqueous base fluids, and any combinations thereof. The term "base fluid" refers to the major component of the fluid (as opposed to components dissolved and/or suspended therein), and does not indicate any particular condition or property of that fluid such as its mass, amount, pH, etc. Aqueous fluids that may be suitable for use in the methods and systems of the present disclosure may comprise water from any source. Such aqueous fluids may comprise fresh water, salt water (e.g., water containing one or more salts dissolved therein), brine (e.g., saturated salt water), seawater, or any combination thereof. In most embodiments of the present disclosure, the aqueous fluids comprise one or more ionic species, such as those formed by salts dissolved in water. For example, seawater and/or produced water may comprise a variety of divalent cationic species dissolved therein. In certain embodiments, the density of the aqueous fluid may be adjusted, among other purposes, to provide additional particulate transport and suspension in the compositions of the present disclosure. In certain embodiments, the pH of the aqueous fluid may be adjusted (e.g., by a buffer or other pH adjusting agent) to a specific level, which may depend on, among other factors, the types of viscosifying agents, acids, and other additives included in the fluid. One of ordinary skill in the art, with the benefit of this disclosure, will recognize when such density and/or pH adjustments are appropriate. Examples of non-aqueous fluids that may be suitable for use in the methods and systems of the present disclosure include, but are not limited to, oils, hydrocarbons, carbon dioxide, organic liquids, and the like. In certain embodiments, one or more treatment fluids may comprise a mixture of one or more fluids and/or gases, including but not limited to emulsions, foams, and the like.

In certain embodiments, the drilling fluids, fracturing fluids, working fluids, or other treatment fluids used in the methods and compositions of the present disclosure optionally may comprise any number of additional additives. Examples of such additional additives include, but are not limited to, salts, surfactants, acids, spacers, diverting agents, fluid loss control additives, gas, nitrogen, carbon dioxide, surface modifying agents, gelling agents, foamers, corrosion inhibitors, scale inhibitors, etching agents, catalysts, clay control agents, biocides, friction reducers, antifoam agents, bridging agents, flocculants, additional $H_2S$ scavengers, $CO_2$ scavengers, oxygen scavengers, lubricants, additional viscosifiers, breakers, weighting agents, relative permeability modifiers, resins, wetting agents, coating enhancement agents, filter cake removal agents, antifreeze agents (e.g., ethylene glycol), and the like. In certain embodiments, one or more of these additional additives (e.g., a crosslinking agent) may be added to the treatment fluid and/or activated after the viscosifying agent has been at least partially hydrated in the fluid. A person skilled in the art, with the benefit of this disclosure, will recognize the types of additives that may be included in the fluids of the present disclosure for a particular application.

The drilling fluids, fracturing fluids, working fluids, or other treatment fluids of the present disclosure may be prepared using any suitable method and/or equipment (e.g., blenders, mixers, stirrers, etc.) known in the art at any time prior to their use. The treatment fluids may be prepared at a well site or at an offsite location. In certain embodiments, the treatment fluids may be introduced in a dry or slurried state. In certain embodiments, the anchoring agent and/or other components of the treatment fluid may be metered directly into a base fluid to form a treatment fluid. In certain embodiments, the base fluid may be mixed with the fine particulates and/or other components of the treatment fluid at a well site where the operation or treatment is conducted, either by batch mixing or continuous ("on-the-fly") mixing. The term "on-the-fly" is used herein to include methods of combining two or more components wherein a flowing stream of one element is continuously introduced into a flowing stream of another component so that the streams are combined and mixed while continuing to flow as a single stream as part of the on-going treatment. Such mixing can also be described as "real-time" mixing. In other embodiments, the treatment fluids of the present disclosure may be prepared, either in whole or in part, at an offsite location and transported to the site where the treatment or operation is conducted. In injecting a treatment fluid of the present disclosure into a portion of a formation, the components of the treatment fluid may be mixed together at the surface and introduced into the formation together, or one or more components may be introduced into the formation at the surface separately from other components such that the components mix or intermingle in a portion of the formation to form a treatment fluid. In either case, the treatment fluid is deemed to be introduced into at least a portion of the formation for purposes of the present disclosure. In certain embodiments, the treatment fluid may be introduced into the fractures of a formation or into a closed subterranean system to be heated by the formation and extracted for geothermal energy production.

The present disclosure provides methods for using working fluids to extract geothermal energy from a subterranean system. A working fluid may be injected into a subterranean system through an injection inlet, allowed to heat within the subterranean system, and produced through a production outlet. After production, the heated working fluid may be used to drive one or more turboexpanders for geothermal energy production. In certain embodiments, the working fluid may pass through one or more wellbores, primary fractures, secondary fractures, and/or etched conductive channels in a subterranean formation. In certain embodiments, the working fluid may include one or more etching agents and/or scale inhibitors to enhance the subterranean system. In certain embodiments, production of the working fluid may be halted or the rate of production of the working fluid may be slowed for a certain period of time, and thereafter resumed or increased to a level at or near its previous rate. Intermittent production may (1) allow the fluid to reach a higher temperature; (2) increase the amount of time etching agents and/or scale inhibitors have to affect the subterranean formation; and (3) increase pressure within the subterranean system, thereby dilating existing fractures and etched conductive channels to expose additional surface area. The increased surface area may improve one or more of the rate and total extent of heat transfer.

The present disclosure provides methods for using the treatment fluids to carry out hydraulic fracturing treatments. In certain embodiments, one or more treatment fluids (e.g., pad fluids, pre-pad fluids, and/or other fluids) may be introduced into a formation, for example, through a wellbore that penetrates a formation. In certain embodiments, one or more of the treatment fluids may be introduced at a pressure sufficient to create or enhance one or more fractures within the formation. The treatment fluid may also include one or more additives (gelling agents, weighting agents, and/or other optional additives) to alter properties of one or more wellbores and/or the subterranean formation. For example, the other additives may be included to reduce pumping friction, to reduce or eliminate the fluid's reaction to the geological formation in which the well is formed, to operate as surfactants, and/or to serve other functions. In certain embodiments, the treatment fluid may include one or more etching agents and/or scale inhibitors to enhance the subterranean system.

In certain embodiments, an etching agent may be introduced into the subterranean system as a component of one or more of a treatment fluid, fracturing fluid, working fluid, or drilling fluid. In certain embodiments, the etching agent may be introduced to the subterranean system through a working fluid periodically. The etching agent may comprise one or more of an acid, a hydrolysable in-situ acid generator, a chelant, and a hydrolysable in-situ chelant generator. The etching agent may expand existing fractures in the subterranean formation and/or add additional conductive channels. In applications in which a chelant is used as part or all of the etching agent, the etching agent may inhibit the formation of scale within the subterranean system. In certain embodiments, an etching agent may be injected into the injection inlet before applying hydraulic fracturing treatments. In this way, the hydraulic fracturing treatments may push the etching agent to the distal ends of the fractures, thereby enhancing the etching activity and/or its effects.

Some etching agents described herein (including and without limitation chelant-based etching agents) may be particularly effective at reacting with and removing carbonate materials such as calcite, calcium carbonate, and the like from subterranean formations. Such carbonate materials are naturally and non-uniformly embedded within subterranean formations. Upon contact with an etching agent, the carbonate materials may solubilize and/or be removed, thereby leaving etches or voids in the formation rock where the carbonate material once was. The etches may be in any shape or size and may contribute to the formation of a conductive channel through which produced fluids (e.g., working fluids) may flow. As used herein, the term "conductive channel" refers to an opening of any size or shape (for example and without limitation, cracks, slots, channels, perforations, holes, wormholes, or any other structure) formed from etching a subterranean formation by removing material therefrom with an etching agent. Conductive channels created by etching agents may allow fluids to flow from the subterranean formation and into a wellbore either directly, through fractures, or through other conductive channels.

In certain embodiments, a chelant may serve as one or more of an etching agent or a scale inhibitor. The chelant may be introduced into the subterranean system as one or more of a liquid or a solid. In certain embodiments, solid chelants may be used to be placed in the propped fractures. Solid chelants may include, for example and without limitation, one or more phosphonic acid-type chelants. Phosphonic acid type chelants are defined as chelants comprising a phosphonic acid moiety (—PO3H2) or its derivative —PO3R2, wherein R may be an alkyl or aryl radical. Suitable phosphonic acid-type chelants may include, but are not limited to, aminopolyphosphonic acids, polyphosphonic acids, derivatives thereof, and mixtures thereof. In certain embodiments, solid chelants may be modified to include carboxylic acid groups in the place of one or more of any of the phosphonic acid groups, so long as one phosphonic acid group is still present in the molecule. Examples of such compounds containing phosphonic acid and carboxylic acid groups include, without limitation, phosphonobutane-tricarboxylic acid (PBTC), N-(phosphonomethyl)iminodiacetic acid (PMIDA), 2-carboxyethyl phosphonic acid (CEPA), and 2-hydroxyphosphonocarboxylic acid (HPAA). Other examples of chelant used in one or more embodiments of the present disclosure include 1,2-cyclohexanediaminetetraacetic acid (CDTA), diethylenetriamineepentaacetic acid (DTPA), ethanol-diglycinic acid (EDG), ethylenediaminetetraacetic acid (EDTA), N,N-bis(carboxymethyl)glycine (NTA), L-glutamic acid N,N-diacetic acid, tetra sodium salt (GLDA), HEDTA (N-hydroxyethyl-ethylenediamine-triacetic acid), hydroxyaminocarboxylic acid (HACA), hydroxyethyleneiminodiacetate (HEIDA), and sodium hexametaphosphate (SHMP), or derivatives and/or mixtures thereof.

In certain embodiments of the present disclosure, one or more etching agents may include N-phosphonomethyl iminodiacetic acid (PMIDA), which has the below structure:

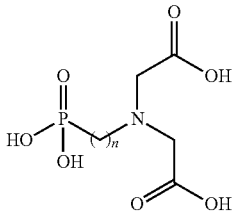

In some embodiments, one or more etching agents may include phosphono(amino-carboxylic) acids such as N,N-bis(phosphonomethyl)glycine. In certain embodiments, the treatment fluid may include one or more diphosphonic and aminophosphonic acids that remain substantially undissolved in the fluids of the present disclosure. Representative examples of such compounds that may be used include, but are not limited to, phosphonobutane-1,2,4-tricarboxylic acid, iminobis(methylenephosphonic acid), and nitrilotris (methylene phosphonic acid). In certain embodiments, PMIDA may serve as a slowly reactive acid component present in one or more of a treatment fluid, fracturing fluid, working fluid, or drilling fluid. Once injected, the PMIDA may react with the shale and/or calcite-laden formation to etch and/or widen the channels extended from the natural and induced fractures.

PMIDA may be compatible for use in the high temperature environments common to the present disclosure. PMIDA may be thermally stable as a solid up to about 419° Fahrenheit ("F") and may have an even greater stability when dissolved in a fluid phase. Accordingly, PMIDA may be effectively used in a geothermal subterranean system, often without actively cooling a wellbore therein. Even at the high temperatures of geothermal subterranean systems, PMIDA usually reacts with geothermal scale in a controlled manner, again allowing geothermal descaling operations to take place at the native temperature of the geothermal subterranean system and/or without taking special precautions to control the chemical reactivity.

In certain embodiments, a hydrolysable in-situ chelant generator may be included in and/or may react to generate one or more etching agents. In certain embodiments, the hydrolysable in-situ chelating agent generator may comprise a chelant and a polymer capable of hydrolyzing to an acid. In certain embodiments, the polymer may include one or more phosphonate monomers, sulfonate monomers, and/or combinations thereof. The one or more phosphonate monomers may include one or more of 2-aminoethylphosphonic acid, dimethyl methylphosphonate, 1-hydroxy ethylidene-1, 1-diphosphonic acid, amino tris(methylene phosphonic acid), ethylenediamine tetra(methylene phosphonic acid), tetramethylenediamine tetra(methylene phosphonic acid), hexamethylenediamine tetra(methylene phosphonic acid), diethylenetriamine penta(methylene phosphonic acid), phosphonobutane-tricarboxylic acid, n-(phosphonomethyl) iminodiacetic acid, 2-carboxyethyl phosphonic acid, 2-hydroxyphosphonocarboxylic acid, amino-tris-(methylene-phosphonic acid), and combinations thereof. The one or more sulfonate monomers may include one or more of vinylsulfonic acid, styrenesulfonic acid, allylsulfonic acid, methallylsulfonic acid, acrylamide-2-methylpropanesulfonic acid, sodium 2-hydroxy-3-allyloxypropane sulfonate, sodium 2-hydroxy-3-methacryloxypropane sulfonate, isoprene sulfonate, sulfoethyl acrylate, sulfoethyl methacrylate, sulfopropyl acrylate, sulfopropyl methacrylate, 2-hydroxy-3-butene sulfonate, and other suitable sulfonate monomers.

In certain embodiments, a hydrolysable in-situ acid generator may be included in and/or may react to generate one or more etching agents. In certain embodiments, an in-situ acid generator may comprise one or more hydrolysable acid esters. In certain embodiments, the one or more hydrolysable acid esters may comprise one or more homopolymers and/or copolymers of lactic acid, one or more homopolymers and/or copolymers of glycolic acid, one or more homopolymers and/or copolymers of vinyl methylsulphonate, one or more homopolymers and/or copolymers of vinyl methylphosphonate, one or more homopolymers and/or copolymers of dimethylphosphonate, or combinations thereof.

In certain embodiments, one or more scale inhibitors may be introduced in the subterranean system. The one or more scale inhibitors may be one or more of solid slow-release scale inhibitors, liquid scale inhibitors, and/or etching chelants. Regardless of form, one or more scale inhibitors may prevent scale from forming on surfaces on which the working fluid is in contact. Furthermore, the one or more scale inhibitors may maintain the connective microfractures/channels between propped fractures in the subterranean formation. In certain embodiments, one or more solid slow-release scale inhibitors may be placed in propped fractures in the subterranean formation as part of a hydraulic fracturing treatment to help prevent scale formation in the fluid flow paths. In certain embodiments, the one or more scale inhibitors may be injected into the subterranean formation via one or more of a treatment fluid, fracturing fluid, working fluid, or drilling fluid. In certain embodiments, the etching agent may be periodically reintroduced to the subterranean formation through a working fluid. In applications in which a chelant is used as part or all of the one or more scale inhibitors, the chelant may also serve to create one or more conductive channels within the formation.

In one or more embodiments, one or more phosphonates, phosphates, sulfonates, acrylates, carboxylates, and any combinations thereof may be used as liquid scale inhibitors and/or solid slow-release scale inhibitors. Examples of scale inhibitors may also include organo phosphonates, organo phosphates, phosphate esters, and the corresponding acids and salts thereof. Furthermore, scale inhibitors may include polymeric scale inhibitors, such as polyacrylamides, salts of acrylamido-methyl propane sulfonate/acrylic acid copolymer (AMPS/AA), phosphinated maleic copolymer (PHOS/MA) or sodium salt of polymaleic acid/acrylic acid/acrylamido-methyl propane sulfonate terpolymers (PMA/AMPS). In one or more embodiments, the scale inhibitors can include DTPA, (also known as diethylenetriamine pentaacetic acid; diethylenetriamine-N,N,N',N',N"-pentaacetic acid; pentetic acid; N,N-Bis(2-(bis-(carboxymethyl)amino) ethyl)-glycine; diethylenetriamine pentaacetic acid, [[(Carboxymethyl)imino]bis(ethylenenitrilo)]-tetra-acetic acid); EDTA: (also known as edetic acid; ethylenedinitrilotetraacetic acid; EDTA free base; EDTA free acid; ethylenediamine-N,N,N',N'-tetraacetic acid; hampene; Versene; N,N'-1,2-ethane diylbis-(N-(carboxymethyl)glycine); ethylenediamine tetra-acetic acid); NTA, (also known as N,N-bis(carboxymethyl)glycine; triglycollamic acid; trilone A; alpha,alpha',alpha"-trimethylaminetricarboxylic acid; tri (carboxymethyl)amine; aminotriacetic acid; Hampshire NTA acid; nitrilo-2,2',2"-triacetic acid; titriplex i; nitrilotriacetic acid); APCA (aminopolycarboxylic acids); phosphonic acids; EDTMP (ethylenediaminetetramethylene-phosphonic acid); DTPMP (diethylene triaminepentamethylenephosphonic acid); NTMP (nitrilotrimethylenephosphonic acid); polycarboxylic acids, gluconates, citrates, polyacrylates, and polyaspartates or any combination thereof.

In some embodiments, surfactants may act to cause sandstone and/or carbonate (limestone) reservoirs to become oil-wet. Because the surfaces of sandstone formations are normally negatively charged, a cationic surfactant may be used to create an oil-wet condition within sandstone reservoirs. The list of cationic surfactants that may be suitable includes, but is not limited to the following: primary amines, secondary amines, tertiary amines, diamines, quaternary ammonium salts, di-quaternary salts, ethoxylated quaternary salts, ethoxylated amines, ethoxylated diamines, amine acetates, diamine diacetates, any derivatives thereof, and any combinations thereof. Similarly, because the surfaces of carbonate formations are normally positively charged, an anionic surfactant may be used to create an oil wet condition within carbonate reservoirs. The list of anionic surfactants that may be suitable includes, but is not limited to, the following: sulfonic acids and their salts, sulfates, ether sulfates, sulfonates, alpha-olefin sulfonates, ethoxylated carboxylates, sulfosuccinates, phosphate esters, alkyl naphthalene sulfonates, napthalene sulfonate condensate, any derivatives thereof, and any combinations thereof.

In certain embodiments of the present disclosure, a proppant may be provided and/or included in a treatment fluid of the present disclosure. Examples of proppant materials that may be suitable in certain embodiments include, but are not limited to, silica (sands), graded sands, Ottawa sands, Brady sands, Colorado sands; resin-coated sands; gravels; synthetic organic particles, nylon pellets, high density plastics, polytetrafluoroethylenes, rubbers, resins; ceramics, aluminosilicates; glass; sintered bauxite; quartz; aluminum pellets; ground or crushed shells of nuts, walnuts, pecans, almonds, ivory nuts, brazil nuts, and the like; ground or crushed seed shells (including fruit pits) of seeds of fruits, plums, peaches, cherries, apricots, and the like; ground or crushed seed shells of other plants (e.g., maize, corn cobs or corn kernels); crushed fruit pits or processed wood materials, materials derived from woods, oak, hickory, walnut, poplar, mahogany, and the like, including such woods that have been processed by grinding, chipping, or other techniques for forming particles; or combinations thereof. It is within the ability of one skilled in the art, with the benefit of this disclosure, to select one or more suitable proppants for use in embodiments of the present disclosure. In some embodiments, the particle size of the proppant introduced into the formation is gradually increased from medium- to coarse-sized fracturing sand or other proppant. The gradual increase in particle size may facilitate placement of the particles in the dominant fracture and larger branches. In certain embodiments, the proppant may be mixed with a fracturing fluid to produce a proppant slurry. The proppant may serve, among other purposes, to prop open fractures, thereby maintaining the integrity of a formation, allowing fluid to pass through the propped area, and/or conducting heat. After the proppant is introduced into the formation, the fracture may be allowed to close and hold the proppant in place between the fracture faces.

In certain embodiments, production of the working fluid may be halted or slowed for certain periods of time. Intermittent production may serve one or more functions to increase the subterranean system's surface area, thermal efficiency, and/or flow rate. For example, intermittent production may give additional time for liquid scale inhibitors and/or etching agents in the working fluid to affect the subterranean system. Furthermore, intermittent production may build pressure within the subterranean system, thereby expanding fractures and creating additional conductive channels for enhanced fluid flow and thermal conductivity. Moreover, intermittent production may allow the working fluid additional time to heat within the subterranean system. In some embodiments, injection may be halted or slowed for part or all of the time production is halted or slowed. In some embodiments, injection may be continuous regardless of whether production is halted or slowed.

In certain embodiments, the period of time during which production may be halted or slowed may range from twelve hours to one month. In certain embodiments, the period of time in which production may occur may range from one day to seven days. In certain embodiments, the halting periods and production periods may vary in length. In certain embodiments, the duration of slowing periods, halting periods, and/or production periods may be pre-determined; in other embodiments, the duration of slowing periods, halting periods, and/or production periods may be determined by one or more operators in real time. In certain embodiments, production may be started, slowed, halted, increased, and/or restarted through the use of one or more shut-off valves. In certain embodiments, production may be started, slowed, halted, increased and/or restarted by adjusting the rates of one or more high-temperature electric submersible pumps (ESPs).

Certain embodiments of the methods and compositions disclosed herein may directly or indirectly affect one or more components or pieces of equipment associated with the disclosed compositions. For example, FIG. 1 is a schematic diagram illustrating a subterranean system having wellbores and propped fractures in a subterranean formation, in accordance with certain embodiments of the present disclosure. The subterranean formation 100 includes a production wellbore 101 that has been drilled from the surface 102 to penetrate at least a portion of the formation 100. As shown, production wellbore 101 includes at least one substantially vertical portion 101*a* extending from location 102 at the surface and at least one substantially horizontal portion 101*b* that extends from the bottom of the vertical portion 101*a*. The production wellbore 101 may be coupled to an electricity generator 109, for example and without limitation, a turbine. The subterranean formation 100 also includes an injection wellbore 103 that has been drilled from a location 104 at the surface to penetrate at least a portion of the formation 100. As shown, injection wellbore 103 includes at least one substantially vertical portion 103*a* extending from the surface at location 104 and at least one substantially horizontal portion 103*b* that extends from the bottom of the vertical portion 103*a*. Further, the injection wellbore 103 may be coupled to an injection pump 107. In some embodiments, the horizontal portion 101*b* of the production wellbore 101 may be parallel to the horizontal portion 103*b* of the injection wellbore 103. In some embodiments, the horizontal portions 101*b* and 103*b* of the injection wellbore 103 may be within a range of 50 to 1000 feet of one another.

In certain embodiments, the fractures 105 may be created and/or propped via both the injection wellbore 103 and the production wellbore 101. In certain embodiments, the fractures 105 may be created in parallel to one another. In certain embodiments, the fractures may be created such that each primary fracture generated by one wellbore is located between, or in close proximity to, two primary fractures generated by the other wellbore. In certain embodiments, one or more etching agents may create or enlarge one or more conductive channels 108 at or near the distal end of one or more fractures 105 that connect one or more fractures 105.

In certain embodiments, a working fluid may be injected into an injection wellbore 103 and may travel to one or more propped fractures 105 and/or conductive channels 108 to absorb heat in the rock formation. Subsequently, a high-temperature working fluid may travel from the propped fractures 105 and/or conductive channels 108 to a production wellbore 101 for production. In certain embodiments, the high-temperature working fluid may then be used to generate electricity. For example and without limitation, the high-temperature working fluid may be routed through one or more electricity generators (for example and without limitation, one or more turbo-expanders), wherein the effluent fluids discharged from the turboexpanders may pass through a heat exchanger and be recycled to the injection wellbore 103. In certain embodiments, the working fluid may contain one or more scale inhibitors and/or one or more etching agents when injected. In certain embodiments, production of the working fluid may be intermittently halted or slowed for a certain period of time.

In certain embodiments, one or more wellbores (e.g., wellbores 101*a-b* and 103*a-b*) may be drilled via a drilling fluid. In certain embodiments, the drilling fluid may include one or more scale inhibitors and/or one or more etching agents.

Figure 2:
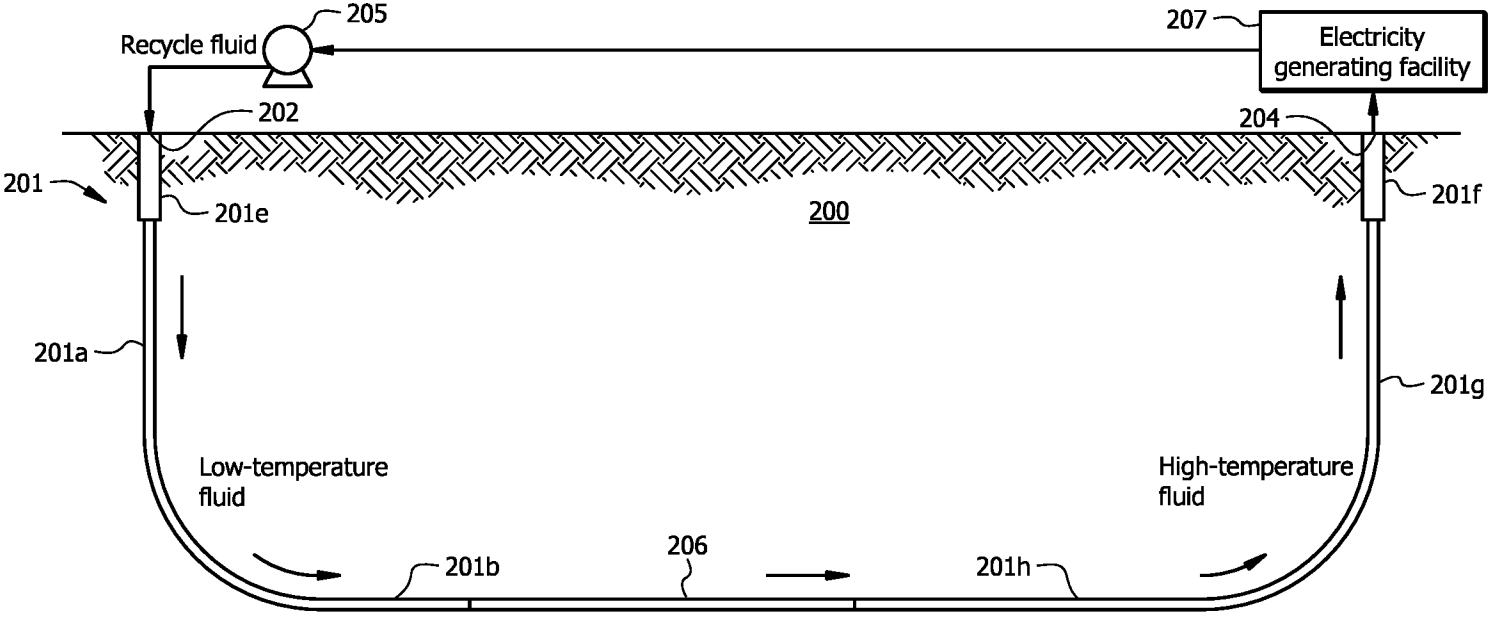
FIG. 2 is a schematic diagram illustrating an example of a closed loop subterranean system, in accordance with certain embodiments of the present disclosure.

FIG. 2 is a schematic diagram illustrating an example of a closed loop subterranean system, in accordance with certain embodiments of the present disclosure. The subterranean formation 200 includes a wellbore 201 that has been drilled from the surface 202 to penetrate at least a portion of the formation 200. As shown, the first wellbore 201 includes an injection inlet 201*e* at or near the surface at location 202. Wellbore 201 includes at least one substantially vertical portion 201*a* extending from location 202 at the surface and at least one substantially horizontal portion 201*b* that extends from the bottom of the vertical portion 201*a*. Further, the injection inlet 201*e* may be coupled to an injection pump 205. The first wellbore 201 also includes a production outlet 201*f* at or near the surface at location 204. As shown, the portion of wellbore 201 that connects to the production outlet 201*f* includes at least one substantially vertical portion 201*g* extending from the surface at location 204 and at least one substantially horizontal portion 201*h* that extends from the bottom of the vertical portion 201*g*. The production outlet 201*f* may be coupled to an electricity generator 207, for example and without limitation, a turbine. The horizontal portions 201*b* and 201*h* of the first wellbore 201 connect at a location 206 to form a closed loop system.

In certain embodiments, a working fluid may be injected into an injection inlet 201*e* of the closed-loop wellbore 201. The working fluid may be heated as it passes through a region of the closed wellbore that is heated by a hot underground formation. The heated working fluid may then be produced via a production outlet 201*f*. In certain embodiments, the heated working fluid may be used to generate electricity. For example and without limitation, the heated working fluid may be routed through one or more electricity generators (for example and without limitation, one or more turboexpanders), wherein the effluent fluids discharged from the turboexpanders may pass through a heat exchanger and be recycled to the injection inlet 201*e*. In certain embodiments, the working fluid may contain one or more scale inhibitors when injected. In certain embodiments, production of the working fluid may be intermittently halted or slowed.

In certain embodiments, a closed-loop wellbore (e.g., wellbore 201) may be drilled via a drilling fluid. In certain embodiments, the drilling fluid may include one or more scale inhibitors. In certain embodiments, fractures may be created along closed-loop wellbore 201. In certain embodiments, fractures may be used as a storage volume. In certain embodiments, fractures may be used as a heat-exchanging mechanism. In certain embodiments utilizing a closed-loop wellbore (e.g., wellbore 201), fluid pumped into one or more fractures may be stored in the one or more fractures under pressure, given time to heat, and subsequently produced out of a production outlet 201*f*.

Figure 3:
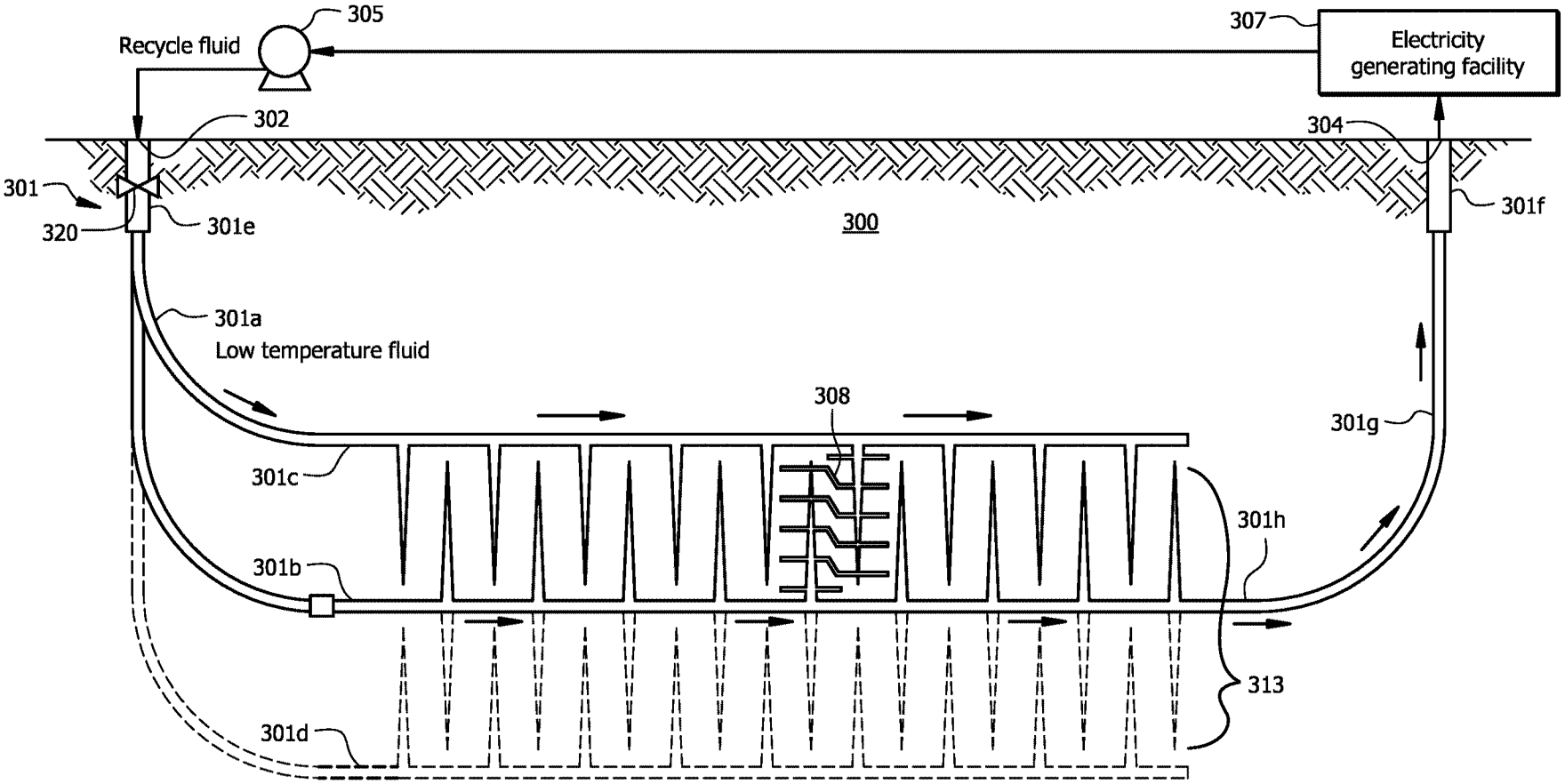
FIG. 3 is a schematic diagram illustrating an example of a subterranean system with propped fractures and a closed loop in a subterranean formation, in accordance with certain embodiments of the present disclosure.

FIG. 3 is a schematic diagram illustrating an example of a subterranean system with propped fractures and a closed loop in a subterranean formation, in accordance with certain embodiments of the present disclosure. The subterranean formation 300 includes a wellbore 301 that has been drilled from the surface 302 to penetrate at least a portion of the formation 300. As shown, the first wellbore 301 includes an injection inlet 301*e* at or near the surface at location 302. Wellbore 301 also includes at least one substantially vertical portion 301*a* extending from location 302 at the surface and at least one substantially horizontal portion 301*b* that extends from the bottom of the vertical portion 301*a*. Further, the injection inlet 301*e* may be coupled to an injection pump 305. The first wellbore 301 also includes a production outlet 301*f* at or near the surface at location 304. As shown, the portion of wellbore 301 that connects to production outlet 301*f* includes at least one substantially vertical portion 301*g* extending from the surface at location 304 and at least one substantially horizontal portion 301*h* that extends from the bottom of the vertical portion 301*g*. The production outlet 301*f* may be coupled to an electricity generator 307, for example and without limitation, a turbine. In certain embodiments, the horizontal portions 301*b* and 301*h* of wellbore 301 may connect at location 306 to form a connected system. In certain embodiments, the first wellbore 301 may include one or more additional horizontal portions 301*c* and 301*d*. In certain embodiments, one or more of the horizontal portions 301*b*, 301*c*, and 301*d* of the first wellbore 301 may be parallel to one another. In certain embodiments, one or more of the horizontal portions 301*b*, 301*c*, and 301*d* of the first wellbore 301 may be within a range of 50 feet to 1000 feet of one or more other horizontal portions 301*b*, 301*c*, or 301*d* of the first wellbore 301. In certain embodiments, one or more etching agents may create or enlarge one or more conductive channels 308 at or near the distal end of one or more fractures 313 that connect one or more fractures 313.

In certain embodiments, the fractures 313 may be created and/or propped via one or more of the injection inlet 301*e* and the production outlet 301*f*. In certain embodiments, the fractures 313 may be created in parallel to one another. In certain embodiments, the fractures may be created such that each primary fracture generated by one horizontal portion 301*b*, 301*c*, or 301*d* of the first wellbore 301 is located between, or in close proximity to, two primary fractures generated by another horizontal portion 301*b*, 301*c*, or 301*d* of the first wellbore 301. FIG. 3 shows fractures 313 originating from only horizontal portions 301*b*, 301*c*, and 301*d* extending from vertical portion 201*a* of the first wellbore 301, but those skilled in the art and with the benefit of this disclosure will understand that fractures 313 may originate from horizontal portions extending from one or more of vertical portions 301*a* or 301*g* of the first wellbore 301.

In certain embodiments, one or more methods disclosed in connection with the systems of FIG. 1 and/or FIG. 2 may be used in tandem. In one or more embodiments, a working fluid may be injected into an injection inlet 301*e* to enter one or more horizontal wellbores 301*b*, 301*c*, and 301*d*. The working fluid may pass from one or more horizontal wellbores 301*b*, 301*c*, and 301*d* to one or more hot fractures 313 and/or conductive channels 308; alternatively, the working fluid may remain within a wellbore 301. After being heated within one or more of the fractures 313, conductive channels 308, or the horizontal wellbores 301*b*, 301*c*, and 301*d*, the heated working fluid may be transferred to a production outlet 301*f*. In certain embodiments, the heated working fluid may be used to generate electricity. For example and without limitation, the heated working fluid may be routed through one or more electricity generators (for example and without limitation, one or more turbo-expanders), wherein the effluent fluids discharged from the turboexpanders may pass through a heat exchanger and be recycled to the injection inlet 301*e*. In certain embodiments, the working fluid may contain one or more scale inhibitors and/or one or more etching agents when injected. In certain embodiments, production of the working fluid may be halted or slowed for a certain period of time, e.g., to trap the working fluid in a subterranean system (e.g., the subterranean system of FIG. 1, FIG. 2, or FIG. 3). This may, inter alia, allow the working fluid in the subterranean system to reach a higher temperature, increase the amount of time etching agents and/or scale inhibitors have to interact with the formation and form conductive channels 308, and/or increase pressure within the subterranean system, thereby increasing the size of fractures 313 and etched conductive channels 308.

The dotted lines 301*d* and 313 of FIG. 3 represent that, in certain embodiments, more than two horizontal wellbores 301*b*, 301*c*, and 301*d* may be drilled (including any accompanied fractures 313). In certain embodiments, a valve 320 may be installed to prevent backflow up the injection inlet 301*e*. For example and without limitation, the valve may be a swell packer, an external casing packer, a flapper-type check valve, a ball-and-seat type check valve, or a downhole ball-type valve. Similar valves optionally may be installed at other locations in the first wellbores (not shown) to prevent backflow and/or otherwise control the flow of fluids in the system shown.

In certain embodiments, one or more wellbores (e.g., wellbores 301*a-h*) may be drilled via a drilling fluid comprising one or more of a drilling fluid, an etching agent, and a scale inhibitor. In certain embodiments, one wellbore may be used for injection, and another wellbore may be used for production.

The methods and systems of FIGS. 1, 2, and 3 are useful to any process in which a heated fluid (including a heated vapor) may be used. For example and without limitation, the methods and systems of FIGS. 1, 2, and 3 may be used to produce heated fluid for energy production, evaporation, heat exchange, and/or to heat one or more nearby buildings. One or more of these processes may be performed on site or at an external location. Modifications to existing oil and gas wells may be performed to achieve any of the first wellbore configurations described in this disclosure. For example and without limitation, in some embodiments, an existing vertical wellbore may be extended (for example and without limitation, by whipstocking) to form one or more horizontal boreholes; this process may be used to produce a well configuration similar to that of FIG. 3. In other embodiments, an existing horizontal wellbore may be extended to produce a well configuration similar to those of FIGS. 1 and 2.

In certain embodiments, one or more specific intervals of one or more propped fractures may be isolated to allow for increased working fluid flow control. The one or more propped fractures with isolated intervals may extend from the injection wellbore, the production wellbore, or a combination thereof. In certain embodiments, flow may be controlled based at least in part on one or more working fluid temperature readings. In certain embodiments, the working fluid's temperature may be recorded at or near the production wellbore.

In certain embodiments, two or more wellbores may be drilled to access a hot formation. One or more intervals of one or more wellbores may be perforated and isolated, starting from the toes of the one or more wellbores. In certain embodiments, a first pad fluid comprising a highly viscous and/or crosslinked fluid may be provided. In certain embodiments, a second pad fluid comprising a linear, low-viscosity fluid may be provided. In certain embodiments, a third pad fluid comprising a linear, low viscosity fluid containing one or more delayed acids and/or delayed chelating agents may be provided. In certain embodiments, a proppant slurry comprising proppant and one or more solid slow-release scale inhibitors may be provided.

In certain embodiments, the first pad fluid and the second pad fluid may be sequentially and repeatedly injected at a pressure sufficient to create one or more primary fractures via the first pad fluid and to create one or more secondary fractures branching out from the one or more primary fractures via the second pad fluid. In certain embodiments, the third pad fluid may be injected to allow one or more of the delayed acid and the delayed chelating agent to be placed inside the secondary fractures to form one or more conductive channels. In certain embodiments, the proppant slurry may be injected to prop the primary fractures open. In certain embodiments, one or more of the methods of this paragraph may be repeated to create additional fractures and/or conductive channels.

In certain embodiments, a low-temperature working fluid may be injected. In one or more embodiments, the low-temperature working fluid may be allowed to pass through (and be heated by) one or more wellbores, fractures, and/or conductive channels. In one or more embodiments, the heated working fluid may carry one or more solid slow-release scale inhibitors in the propped fractures to treat additional surfaces with which the heated working fluid is in contact in the fluid flow paths. In certain embodiments, the heated working fluid may be produced and routed through one or more turboexpanders to generate electricity. In certain embodiments, the effluent fluids discharged from the turboexpanders may pass through a heat exchanger to be transformed back to a low-temperature working fluid before being recycled to the injection inlet.

An embodiment of the present disclosure is a method comprising: injecting an etching agent into an injection inlet of a first wellbore penetrating a first portion of a subterranean formation, wherein the injection inlet is disposed at a first location at or near a surface of the subterranean formation; injecting a working fluid having a first temperature into the injection inlet; allowing at least a portion of the working fluid to flow from the injection inlet to a production outlet of a second wellbore penetrating a second portion of the subterranean formation, wherein the production outlet is disposed at a second location at or near the surface of the subterranean formation; and producing the portion of the working fluid out of the production outlet at a first rate and at a second temperature that is higher than the first temperature.

In certain embodiments discussed in the preceding paragraph, one or more conductive channels in fluid communication with the first wellbore and the second wellbore may be etched with the etching agent. In certain of the preceding embodiments, a scale inhibitor may be injected into the injection inlet as a component of one or more of a drilling fluid, a treatment fluid, a fracturing fluid, and the working fluid. In certain of the preceding embodiments, both the etching agent and the scale inhibitor may comprise a chelant. In certain of the preceding embodiments, one or more of the etching agent and the scale inhibitor may comprise PMIDA. In certain of the preceding embodiments, at least a portion of the first wellbore may be drilled from the surface to penetrate at least the first portion of the subterranean formation. In certain of the preceding embodiments, a fracturing fluid may be injected into the first wellbore at a pressure sufficient to create at least a first set of fractures in the subterranean formation extending from and in fluid communication with the first wellbore; and a first plurality of proppant particulates may be injected into at least the first set of fractures, wherein a second wellbore penetrates at least a second portion of the subterranean formation from the surface, and wherein a second set of fractures extends from and is in fluid communication with the second wellbore, and the first set of fractures is in fluid communication with the second set of fractures. In certain of the preceding embodiments, the etching agent may be injected into the first wellbore before injecting the fracturing fluid such that the etching agent is placed in one or more distal ends of the first set of fractures. In certain of the preceding embodiments, the etching agent may be injected into the injection inlet as a component of one or more of a drilling fluid, a treatment fluid, a fracturing fluid, and the working fluid. In certain of the preceding embodiments, the etching agent may be one or more of an acid or a chelant. In certain of the preceding embodiments, one or more solid slow-release scale inhibitors may be injected into the injection inlet as a component of one or more of a drilling fluid, a treatment fluid, a fracturing fluid, and the working fluid, the one or more solid slow-release scale inhibitors comprising one or more of a delayed acid and a delayed chelant. In certain of the preceding embodiments, a first rate of production of the working fluid from the production outlet may be halted or slowed for a first period of time; and the first rate of production of the working fluid from the production outlet may be resumed or increased at or near the first rate after the first period of time.

Another embodiment of the present disclosure is a method comprising: injecting a working fluid having a first temperature into an injection inlet of a first wellbore penetrating a first portion of a subterranean formation, wherein the injection inlet is disposed at a first location at or near a surface of the subterranean formation; allowing at least a portion of the working fluid to flow from the injection inlet to a production outlet of a second wellbore penetrating a second portion of the subterranean formation, wherein the production outlet is disposed at a second location at or near the surface of the subterranean formation; producing the portion of the working fluid out of the production outlet at a first rate and at a second temperature that is higher than the first temperature; halting or slowing a first rate of production of the working fluid from the production outlet for a first period of time; and resuming or increasing the first rate of production of the working fluid from the production outlet at or near the first rate after the first period of time.

In certain embodiments discussed in the preceding paragraph, at least a portion of the first wellbore may be drilled from the surface to penetrate at least the first portion of the subterranean formation. In certain of the preceding embodiments, a fracturing fluid may be injected into the first wellbore at a pressure sufficient to create at least a first set of fractures in the subterranean formation extending from and in fluid communication with the first wellbore; and first plurality of proppant particulates may be injected into at least the first set of fractures, wherein a second wellbore penetrates at least a second portion of the subterranean formation from the surface, and wherein a second set of fractures extends from and is in fluid communication with the second wellbore, and the first set of fractures is in fluid communication with the second set of fractures. In certain of the preceding embodiments, an etching agent may be injected into the injection inlet as a component of one or more of a drilling fluid, a treatment fluid, a fracturing fluid, and the working fluid. In certain of the preceding embodiments, one or more conductive channels capable of facilitating fluid communication between the first wellbore and the second wellbore may be etched with the etching agent. In certain of the preceding embodiments, the etching agent may be one or more of an acid or a chelant. In certain of the preceding embodiments, a scale inhibitor may be injected into the injection inlet as a component of one or more of a drilling fluid, a treatment fluid, a fracturing fluid, and the working fluid. one or more solid slow-release scale inhibitors may be injected into the injection inlet as a component of one or more of a drilling fluid, a treatment fluid, a fracturing fluid, and the working fluid, the one or more solid slow-release scale inhibitors comprising one or more of a delayed acid and a delayed chelant.

Another embodiment of the present disclosure is a method comprising: injecting an etching agent into an injection inlet of a first wellbore penetrating a first portion of a subterranean formation; injecting a scale inhibitor into the injection inlet; injecting a working fluid having a first temperature into the injection inlet disposed at a first location at or near a surface of the subterranean formation; allowing at least a portion of the working fluid to flow from the injection inlet to a production outlet of a second wellbore penetrating a second portion of the subterranean formation, wherein the production outlet is disposed at a second location at or near the surface of the subterranean formation; producing the portion of the working fluid out of the production outlet at a first rate and at a second temperature that is higher than the first temperature; halting or slowing a rate of production of the working fluid from the production outlet for a first period of time; and resuming or increasing the rate of production of the working fluid from the production outlet at or near the first rate after the first period of time, wherein the etching agent and the scale inhibitor comprise PMIDA.

In certain embodiments discussed in the preceding paragraph, a fracturing fluid may be injected into the first wellbore at a pressure sufficient to create at least a first set of fractures in the subterranean formation extending from and in fluid communication with the first wellbore; and a first plurality of proppant particulates may be injected into at least the first set of fractures, wherein a second wellbore may penetrate at least a second portion of the subterranean formation from the surface, and wherein a second set of fractures may extend from and may be in fluid communication with the second wellbore, and the first set of fractures may be in fluid communication with the second set of fractures.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values.

Furthermore, the words "comprising" (and any form of comprising, such as "comprise" and "comprises"), "having" (and any form of having, such as "has" and "have"), "including" (and any form of including, such as "includes" and "include") or "containing" (and any form of containing, such as "contains" and "contain") are to be understood as inclusive or open-ended and do not exclude additional, unrecited elements or method steps. The term "e.g." is to be understood as an abbreviation of the term "for example"; similarly, the term "i.e." is to be understood as an abbreviation of the term "that is." The term "some" is to be understood to mean "one or more"; the term "some" includes "all." The term "coupled" is to be understood to include any connection between two things, including and without limitation a physical connection (including and without limitation a wired connection), a non-physical connection (including and without limitation a wireless connection), or any combination thereof. The terms "fluid" and "fluids" are to be understood as including any form of liquid, gas, or supercritical fluid. As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F. The terms in the claims have their plain, ordinary meaning unless otherwise explicitly and clearly defined by the patentee.

What is claimed is:

1. A method comprising:

injecting an etching agent into an injection inlet of a first wellbore penetrating a first portion of a subterranean formation, wherein the injection inlet is disposed at a first location at or near a surface of the subterranean formation;

injecting a working fluid having a first temperature into the injection inlet;

allowing at least a portion of the working fluid to flow from the injection inlet to a production outlet of a second wellbore penetrating a second portion of the subterranean formation, wherein the production outlet is disposed at a second location at or near the surface of the subterranean formation; and producing the portion of the working fluid out of the production outlet at a first rate and at a second temperature that is higher than the first temperature, wherein the first wellbore and the second wellbore are different.

2. The method of claim 1, further comprising etching, with the etching agent, one or more conductive channels in fluid communication between the first wellbore and the second wellbore.

3. The method of claim 1, further comprising injecting a scale inhibitor into the injection inlet as a component of one or more of a drilling fluid, a treatment fluid, a fracturing fluid, and the working fluid.

4. The method of claim 3, wherein both the etching agent and the scale 4 inhibitor comprise a chelant.

5. The method of claim 1, further comprising drilling at least a portion of the first wellbore from the surface to penetrate at least the first portion of the subterranean formation.

6. The method of claim 1, further comprising:

injecting a fracturing fluid into the first wellbore at a pressure sufficient to create at least a first set of fractures in the subterranean formation extending from and in fluid communication with the first wellbore; and injecting a first plurality of proppant particulates into at least the first set of fractures, wherein the second wellbore penetrates at least the second portion of the subterranean formation from the surface, and wherein a second set of fractures extends from and is in fluid communication with the second wellbore, and the first set of fractures is in fluid communication with the second set of fractures.

7. The method of claim 6, further comprising injecting the etching agent into the first wellbore before injecting the fracturing fluid such that the etching agent is placed in one or more distal ends of the first set of fractures.

8. The method of claim 1, wherein the etching agent is injected into the injection inlet as a component of one or more of a drilling fluid, a treatment fluid, a fracturing fluid, and the working fluid.

9. The method of claim 1, wherein the etching agent is one or more of an acid or a chelant.

10. The method of claim 1, further comprising injecting one or more solid slow-release scale inhibitors into the injection inlet as a component of one or more of a drilling fluid, a treatment fluid, a fracturing fluid, and the working fluid, the one or more solid slow-release scale inhibitors comprising one or more of a delayed acid and a delayed chelant.

11. The method of claim 1, further comprising:

halting or slowing a rate of production of the working fluid from the production outlet for a first period of time; and resuming or increasing the rate of production of the working fluid from the production outlet at or near the first rate after the first period of time.

12. The method of claim 1, wherein allowing the at least the portion of the working fluid to flow from the injection inlet to the production outlet of the second wellbore penetrating the second portion of the subterranean formation comprises allowing the at least a portion of the working fluid to flow from the injection inlet and, via a first set of fractures extending from and in fluid communication with the first wellbore and a second set of fractures extending from and in fluid communication with the second wellbore, to the production outlet of the second wellbore penetrating the second portion of the subterranean formation.

13. A method comprising:

injecting a working fluid having a first temperature into an injection inlet of a first wellbore penetrating a first portion of a subterranean formation, wherein the injection inlet is disposed at a first location at or near a surface of the subterranean formation;

allowing at least a portion of the working fluid to flow from the injection inlet to a production outlet of a second wellbore penetrating a second portion of the subterranean formation, wherein the production outlet is disposed at a second location at or near the surface of the subterranean formation;

producing the portion of the working fluid out of the production outlet at a first rate and at a second temperature that is higher than the first temperature;

halting or slowing a rate of production of the working fluid from the production outlet for a first period of time; and resuming or increasing the rate of production of the working fluid from the production outlet at or near the first rate after the first period of time, wherein the first wellbore and the second wellbore are different.

14. The method of claim 13, further comprising drilling at least a portion of the first wellbore from the surface to penetrate at least the first portion of the subterranean formation.

15. The method of claim 12, further comprising:

injecting a fracturing fluid into the first wellbore at a pressure sufficient to create at least a first set of fractures in the subterranean formation extending from and in fluid communication with the first wellbore; and injecting a first plurality of proppant particulates into at least the first set of fractures, wherein the second wellbore penetrates at least the second portion of the subterranean formation from the surface, and wherein a second set of fractures extends from and is in fluid communication with the second wellbore, and the first set of fractures is in fluid communication with the second set of fractures.

16. The method of claim 13, further comprising injecting an etching agent into the injection inlet as a component of one or more of a drilling fluid, a treatment fluid, a fracturing fluid, and the working fluid.

17. The method of claim 16, further comprising etching, with the etching agent, one or more conductive channels capable of facilitating fluid communication between the first wellbore and the second wellbore.

18. The method of claim 16, wherein the etching agent is one or more of an acid or a chelant.

19. The method of claim 13, further comprising injecting a scale inhibitor into the injection inlet as a component of one or more of a drilling fluid, a treatment fluid, a fracturing fluid, and the working fluid.

20. A method comprising:

injecting an etching agent into an injection inlet of a first wellbore penetrating a first portion of a subterranean formation;

injecting a scale inhibitor into the injection inlet;

injecting a working fluid having a first temperature into the injection inlet disposed at a first location at or near a surface of the subterranean formation;

allowing at least a portion of the working fluid to flow from the injection inlet to a production outlet of a second wellbore penetrating a second portion of the subterranean formation, wherein the production outlet is disposed at a second location at or near the surface of the subterranean formation;

producing the portion of the working fluid out of the production outlet at a first rate and at a second temperature that is higher than the first temperature;

halting or slowing a rate of production of the working fluid from the production outlet for a first period of time; and resuming or increasing the rate of production of the working fluid from the production outlet at or near the first rate after the first period of time, wherein the etching agent and the scale inhibitor comprise N-(phosphonomethyl) iminodiacetic acid (PMIDA), wherein the first wellbore and the second wellbore are different.

21. The method of claim 20, further comprising:

injecting a fracturing fluid into the first wellbore at a pressure sufficient to create at least a first set of fractures in the subterranean formation extending from and in fluid communication with the first wellbore; and injecting a first plurality of proppant particulates into at least the first set of fractures, wherein the second wellbore penetrates at least the second portion of the subterranean formation from the surface, and wherein a second set of fractures extends from and is in fluid communication with the second wellbore, and the first set of fractures is in fluid communication with the second set of fractures.

* * * * *